US008036067B2

(12) United States Patent
Stuart

(10) Patent No.: US 8,036,067 B2
(45) Date of Patent: Oct. 11, 2011

(54) ALARM CLOCK

(76) Inventor: James Prescott Stuart, Prairieville, LA (US)

( * ) Notice: Subject to any disclaimer, the term of this patent is extended or adjusted under 35 U.S.C. 154(b) by 85 days.

(21) Appl. No.: 12/233,282

(22) Filed: Sep. 18, 2008

(65) Prior Publication Data

US 2009/0190446 A1 Jul. 30, 2009

Related U.S. Application Data

(60) Provisional application No. 61/024,689, filed on Jan. 30, 2008.

(51) Int. Cl.
*G04B 23/00* (2006.01)

(52) U.S. Cl. ..... 368/73; 368/244

(58) Field of Classification Search ..... 368/72–73, 368/108–109, 244
See application file for complete search history.

(56) References Cited

U.S. PATENT DOCUMENTS 5,365,494 A * 11/1994 Lynch ..... 368/10
5,966,346 A * 10/1999 Arai ..... 368/263
6,236,622 B1 * 5/2001 Blackman ..... 368/10
6,816,060 B2 * 11/2004 Dorr ..... 340/7.29
2002/0099550 A1 * 7/2002 Emerick, Jr. ..... 704/270
2005/0174889 A1 * 8/2005 Marcantonio et al. ..... 368/12
2007/0057775 A1 * 3/2007 O'Reilly et al. ..... 340/309
2007/0297292 A1 * 12/2007 Kraft et al. ..... 368/73
2008/0172787 A1 * 7/2008 Tao et al. ..... 4/620

* cited by examiner

*Primary Examiner* — Sean Kayes
(74) *Attorney, Agent, or Firm* — Dale J. Ream

(57) ABSTRACT

An alarm clock includes a processor and a plurality of stored audio message files in data communication with the processor. The processor is in data communication with an audio source, a speaker, a display, a user input, and a clock. The alarm clock includes a case containing these components. The processor includes programming to actuate the display to visually present time data from the clock, actuate the speaker to audibly present a first audio message file at a first alarm time, actuate the speaker to audibly present audio from the audio source after the speaker audibly presents the first audio message file, and actuate the speaker to audibly present a second audio message file at a second alarm time, actuate the speaker to audibly present audio from the audio source after the speaker audibly presents the second audio message file.

5 Claims, 6 Drawing Sheets

ALARM CLOCK

RELATED APPLICATIONS

This application relates to and claims the benefit of a previously filed U.S. Provisional Patent Application Ser. No. 61/024689 filed Jan. 30, 2008, and entitled A Message Communication System.

BACKGROUND OF THE INVENTION

This invention relates generally to alarm clocks and, more particularly, to an alarm clock useful with a flash memory card for playing a different predetermined message each consecutive day at a user determined wake up time.

Traditionally, an alarm clock sounds a buzzer or plays the radio at a time that a user had preset the alarm to activate. Complementary user controls typically include an on/off button and a snooze button that causes the alarm feature to deactivate for a predetermined time and then automatically reactivate. Some alarm clocks even provide for activation of a compact disc or cassette tape player.

Various devices are known in the prior art for listening to selected tracks of inspirational, motivational, or devotional messages, such as CD players. Although assumably effective for their intended purposes, use of such devices for the present purposes of playing a different message each consecutive day at the time of waking would require that the user first be awakened in a traditional manner and then operate another device, such as a CD player, to play the desired message. To listen to a different message every day, the user must remember which track was played the previous day, forward to the next consecutive message, and then activate it.

Therefore, it would be desirable to have an alarm clock that immediately plays a predetermined message at a user determined wake up time. Further, it would be desirable to have an alarm clock that causes a next consecutive message to play each day. In addition, it would be desirable to have an alarm clock that includes all of the functionality of a traditional alarm clock as well as user controls relative to the message player.

SUMMARY OF THE INVENTION

An alarm clock according to the present invention includes a processor and a plurality of stored audio message files in data communication with the processor. The processor is in data communication with an audio source, a speaker, a display, a user input, and a clock. The alarm clock includes a case containing these components. The processor includes programming to actuate the display to visually present time data from the clock, actuate the speaker to audibly present a first audio message file at a first alarm time, actuate the speaker to audibly present audio from the audio source after the speaker audibly presents the first audio message file, and actuate the speaker to audibly present a second audio message file at a second alarm time, actuate the speaker to audibly present audio from the audio source after the speaker audibly presents the second audio message file.

Therefore, a general object of this invention is to provide an alarm clock that plays a predetermined message at a user-determined wake up time.

Another object of this invention is to provide an alarm clock, as aforesaid, that plays a different message each time that the alarm is activated.

Still another object of this invention is to provide an alarm clock, as aforesaid, that utilizes audio messages stored on flash memory cards such that different collections of messages may be used interchangeably with the alarm clock.

Yet another object of this invention is to provide an alarm clock, as aforesaid, that includes all of the functionality of a traditional alarm clock as well as user controls specific to the audio message features.

A further object of this invention is to provide an alarm clock, as aforesaid, that may include a traditional alarm function that must first be deactivated before the message file is played.

A still further object of this invention is to provide an alarm clock, as aforesaid, that is user-friendly to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An alarm clock will now be described in detail with reference to FIG. 1 through FIG. 6 of the accompanying drawings. More particularly, an alarm clock 100 includes at least one speaker 110 contained in (i.e., coupled to) a case 102.

Figure 6:
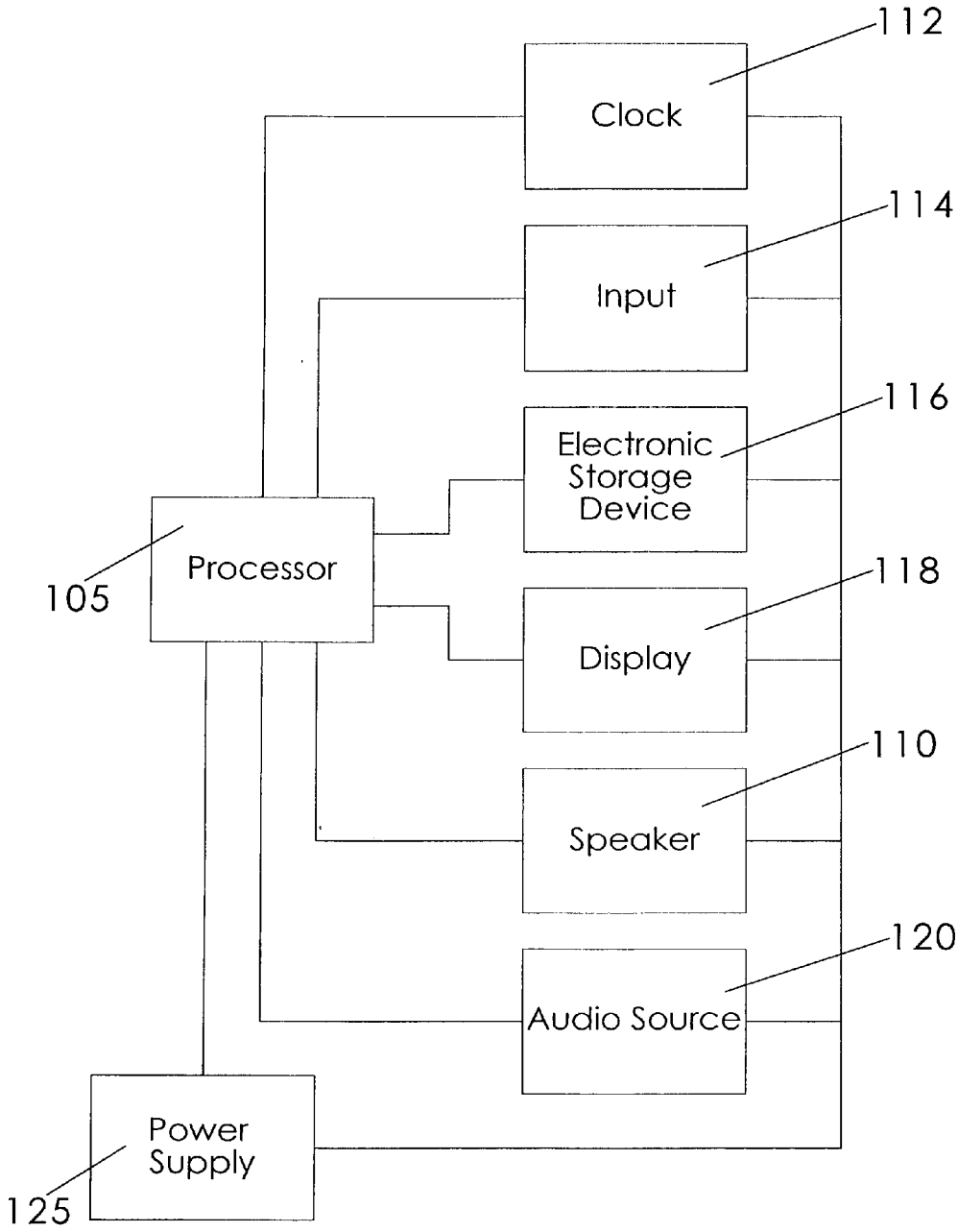
FIG. 6 is a block diagram of the electronic components of the alarm clock according to the present invention.

As shown in FIG. 6, the speaker 110 is in data communication with a processor 105, and the processor 105 is additionally in data communication with a clock 112, a user input 114 (e.g., one or more switch, button, etc.), and a plurality of audio message files stored in an electronic storage device 116 (e.g., a flash drive, etc.). The processor 105 may also be in data communication with a display 118 (e.g., a LCD display, etc.), an audio source 120 (e.g., a radio, compact disc player, DVD player, mp3 player, etc.) and/or an alarm file. The alarm file may be contained in the electronic storage device 116 or another electronic storage device. In addition to the speaker 110, the case 102 may contain the processor 105, the clock 112, the user input 114, the display 118, and/or the audio source 120. It should be appreciated that various elements may alternately be separate from the case 102; for example, the audio source 120 may be external to the case 105 and coupled to the processor 120 through wiring or other communication devices. A power supply 125 (e.g., a battery, standard alternating current, etc.) electrically powers the processor 105, the clock 112, the user input 114, the electronic storage device 116, the display 118, and the audio source 120.

Figure 1:
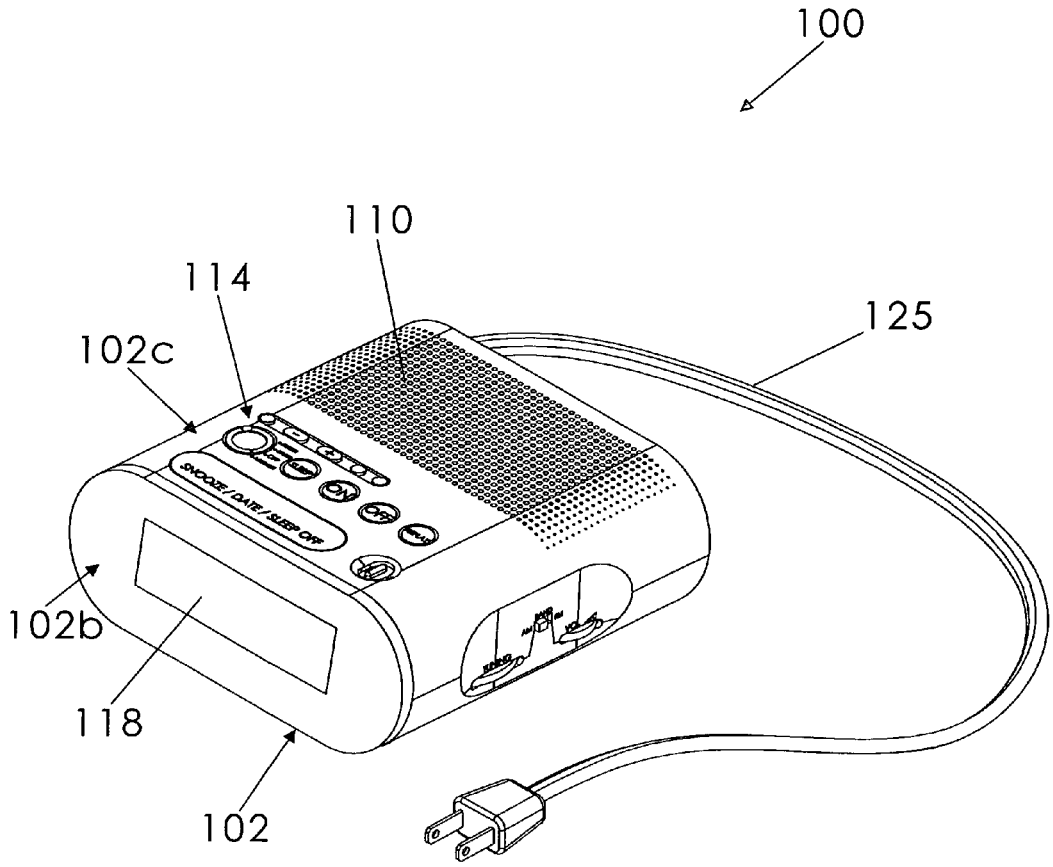
FIG. 1 is a perspective view of an alarm clock according to a preferred embodiment of the present invention.
Figure 2:
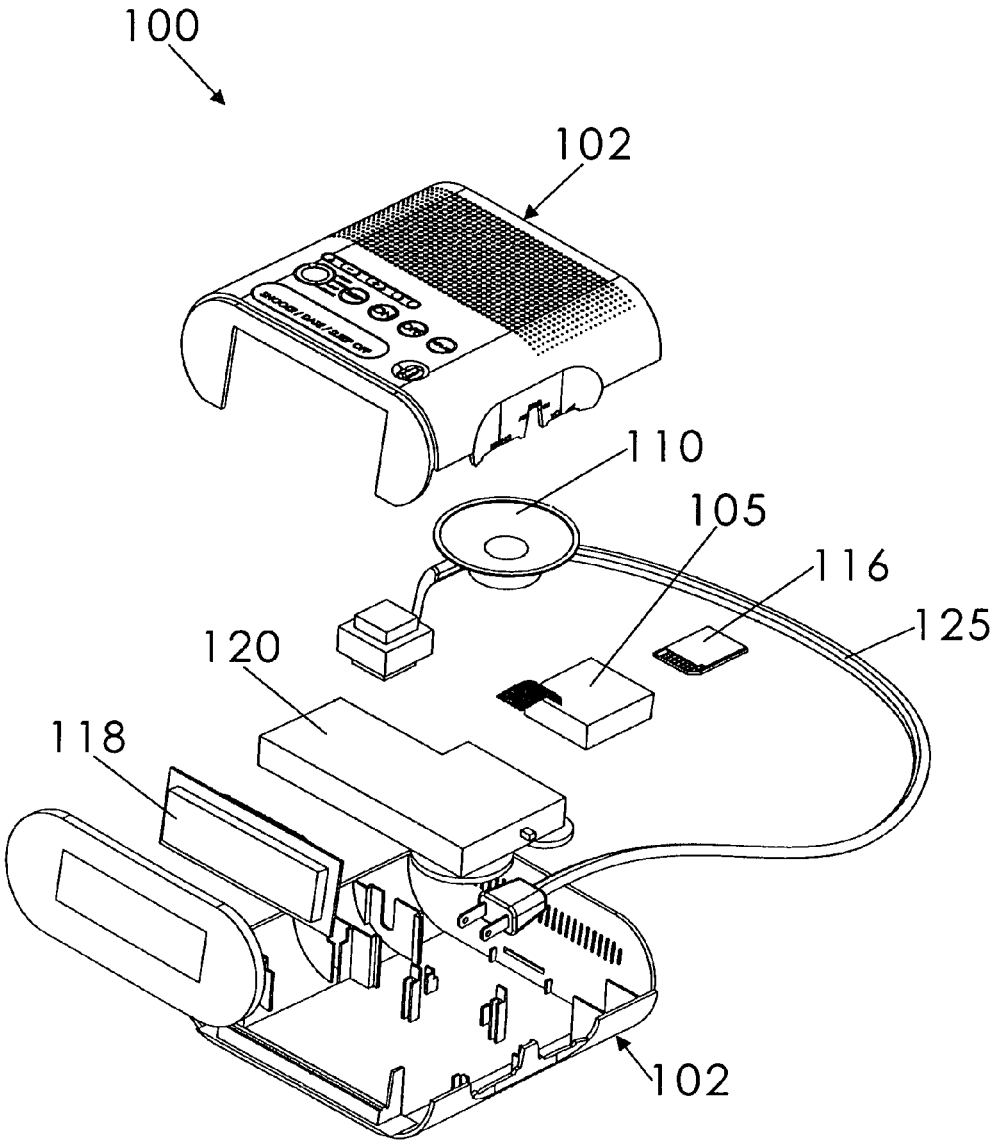
FIG. 2 is an exploded view of the alarm clock as in FIG. 1.
Figure 3A:
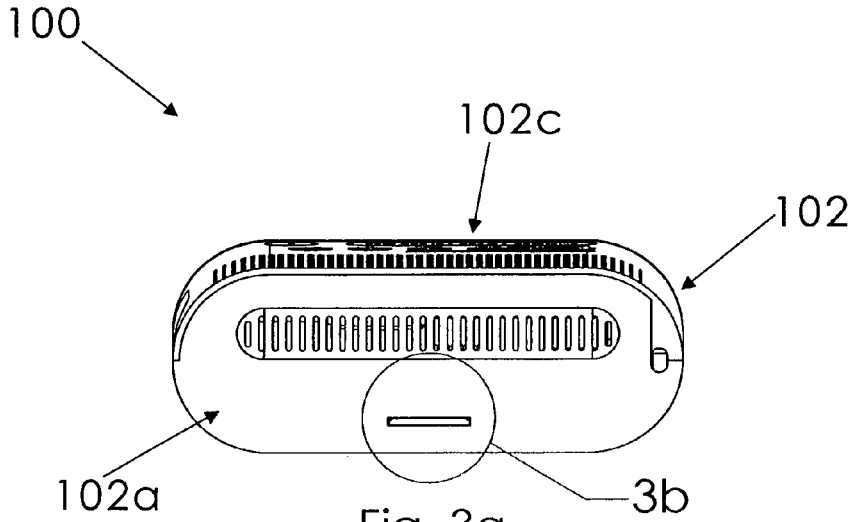
FIG. 3*a* is a rear view of the alarm clock as in FIG. 1.
Figure 3B:
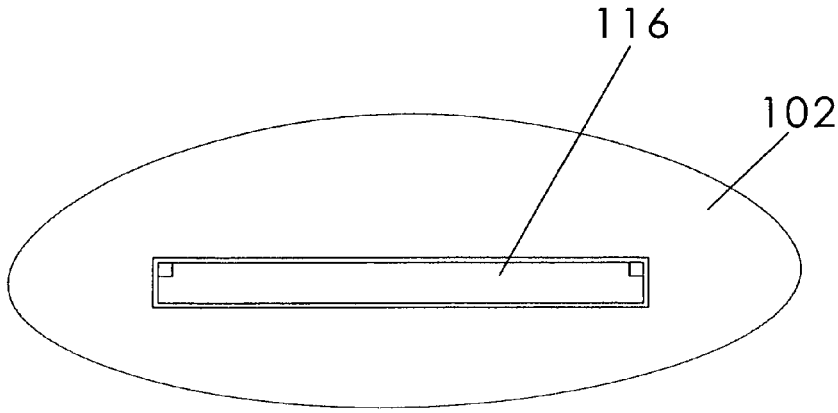
FIG. 3*b* is an isolated view on an enlarged scale taken from a portion of FIG. 3*a;*
Figure 4A:
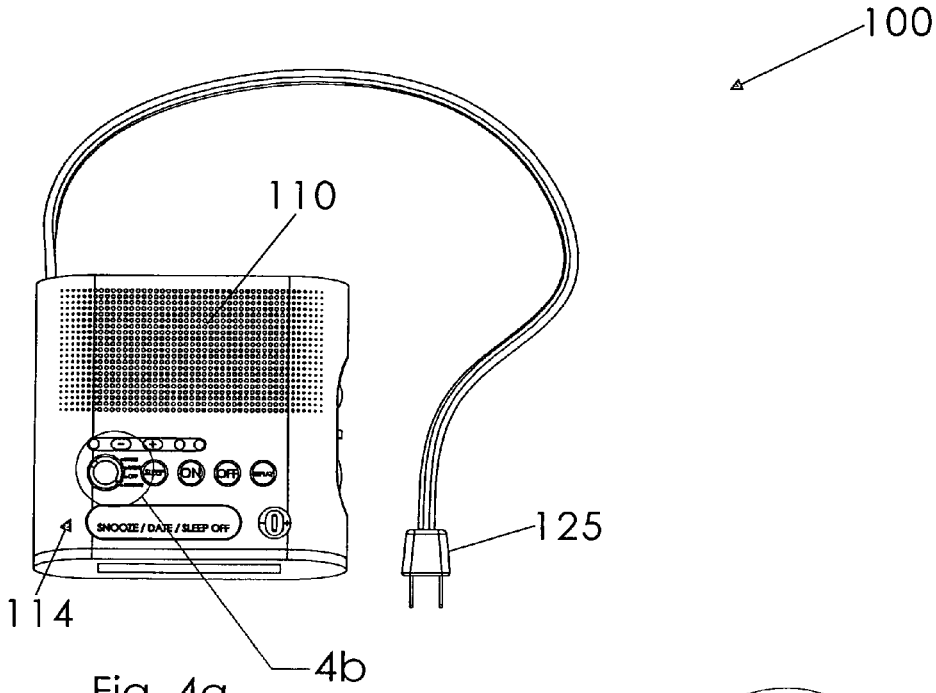
FIG. 4*a* is a top view of the alarm clock as in FIG. 1.
Figure 4B:
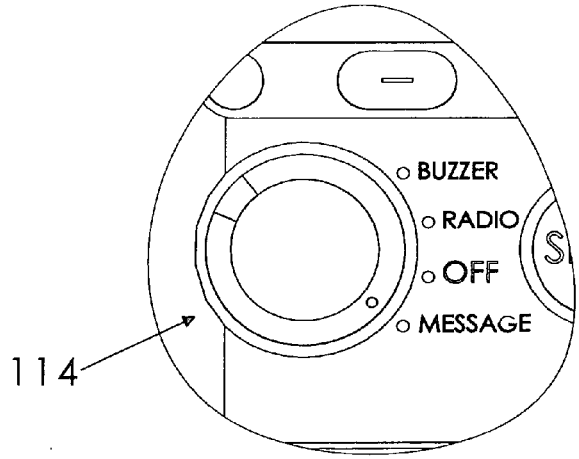
FIG. 4*b* is an isolated view on an enlarged scale taken from a portion of FIG. 4*a;*

While elements are often referred to herein in the singular form, it should be appreciated that multiple elements may acceptably be used. For example, multiple processors 105, speakers 110, user inputs 114, electronic storage devices 116, displays 118, audio sources 120, power supplies 125, etc. may be used. In some embodiments, the electronic storage device 116 is replaceable with another electronic storage device 116 that stores a plurality of different audio message files than those stored in the first electronic storage device 116. FIGS. 3*a* and 3*b*, for example, show that electronic storage devices 116 may be removably received at a rear side 102*a* of the case 102 and may generally remain hidden from view and inaccessible from front and top sides 102*b*, 102*c* of the case 102.

The processor 105 may include various programming, including programming to actuate the display 118 to visually present time data from the clock 112 and programming to actuate the speaker 110. The process 500 shown in the flowchart of FIG. 5 demonstrates various programming in the processor 105 related to actuating the speaker 110. At step S10, the processor 105 determines whether an alarm has been activated (i.e., whether the user has selected an alarm time using the input 114). If not, the process 500 remains at step S10. If so, the process 500 continues to step S12. At step S12, the processor 105 determines whether the enhanced alarm has been activated or whether the standard alarm has been activated (i.e., whether the user has selected the enhanced alarm using the input 114).

If the enhanced alarm has not been activated, the process 500 continues to step S14, where the processor 105 actuates the speaker 110 to audibly present the alarm file when the alarm time occurs (i.e., when the clock 112 indicates that the alarm time selected by the user through input 114 has arrived) for either a predetermined amount of time or until the user silences the speaker 110 using the input 114. The process 500 returns from step S14 to step S10. In some embodiments, a plurality of alarm files are in data communication with the processor 105, and the input 114 is used to select a desired alarm file.

If the enhanced alarm has been activated, the process 500 proceeds from step S12 to step S16, where the processor 105 actuates the speaker 110 to audibly present the alarm file when the alarm time occurs (i.e., when the clock 112 indicates that the alarm time selected by the user through input 114 has arrived). As set forth above in relation to step S14, the alarm file may be selected by the user (using the input 114) from a plurality of alarm files in some embodiments. The process 500 proceeds from step S16 to step S18.

At step S18, the processor 105 determines if the user has selected (i.e., through the input 114) a snooze function. If so, process 500 returns to step S16 after the length of the snooze function (e.g., five minutes). If not, process 500 proceeds to step S20.

At step S20, the processor 105 determines if the user has deactivated the enhanced alarm (i.e., through the input 114). If so, the process 500 returns from step S20 to step S10. If not, the process 500 continues to step S22. Programming in the processor 105 may cause the process 500 to pause a predetermined amount of time between steps S20 and S22 or keep the process 500 from proceeding from step S20 to step S22 until the user provides instructions (i.e., through the input 114) to proceed.

At step S22, the processor 105 actuates the speaker 110 to present one of the audio message files stored in the electronic storage device 116. The process 500 proceeds from step S22 to step S24. At step S24, the processor 105 determines if the user has selected (i.e., through the input 114) a snooze function. If so, process 500 returns to step S22 after the length of the snooze function (e.g., five minutes). If not, process 500 continues to step S26.

At step S26, the processor 105 determines if the user has deactivated the enhanced alarm (i.e., through the input 114). If so, the process 500 proceeds to step S36. If not, the process 500 continues to step S28. Step S36 is discussed in detail below.

At step S28, the processor 105 determines if the audio message file has been completely presented by the speaker 110. If not, the process 500 returns to step S24. If so, the process 500 continues to step S30.

At step S30, the processor 105 actuates the speaker 110 to audibly present audio from the audio source 120. Programming in the processor 105 may cause the process 500 to pause a predetermined amount of time between steps S28 and S30 or keep the process 500 from proceeding from step S28 to step S30 until the user provides instructions (i.e., through the input 114) to proceed. The process 500 continues from step S30 to step S32.

At step S32, the processor 105 determines if the user has selected (i.e., through the input 114) a snooze function. If so, process 500 returns to step S30 after the length of the snooze function (e.g., five minutes). If not, process 500 proceeds to step S34.

At step S34, the processor 105 determines if the user has deactivated the enhanced alarm (i.e., through the input 114). If so, the process 500 proceeds from step S20 to step S36. If not, the process 500 returns to step S30.

At step S36, the processor 105 updates an indicator to keep the processor 105 from repeating the audio message file presented at step S22 from being used with a subsequent alarm until all of the audio message files in the electronic storage device 116 are presented during an alarm. The process 500 continues from step S36 to step S10, and the process 500 is repeated using a different audio message file.

Figure 5:
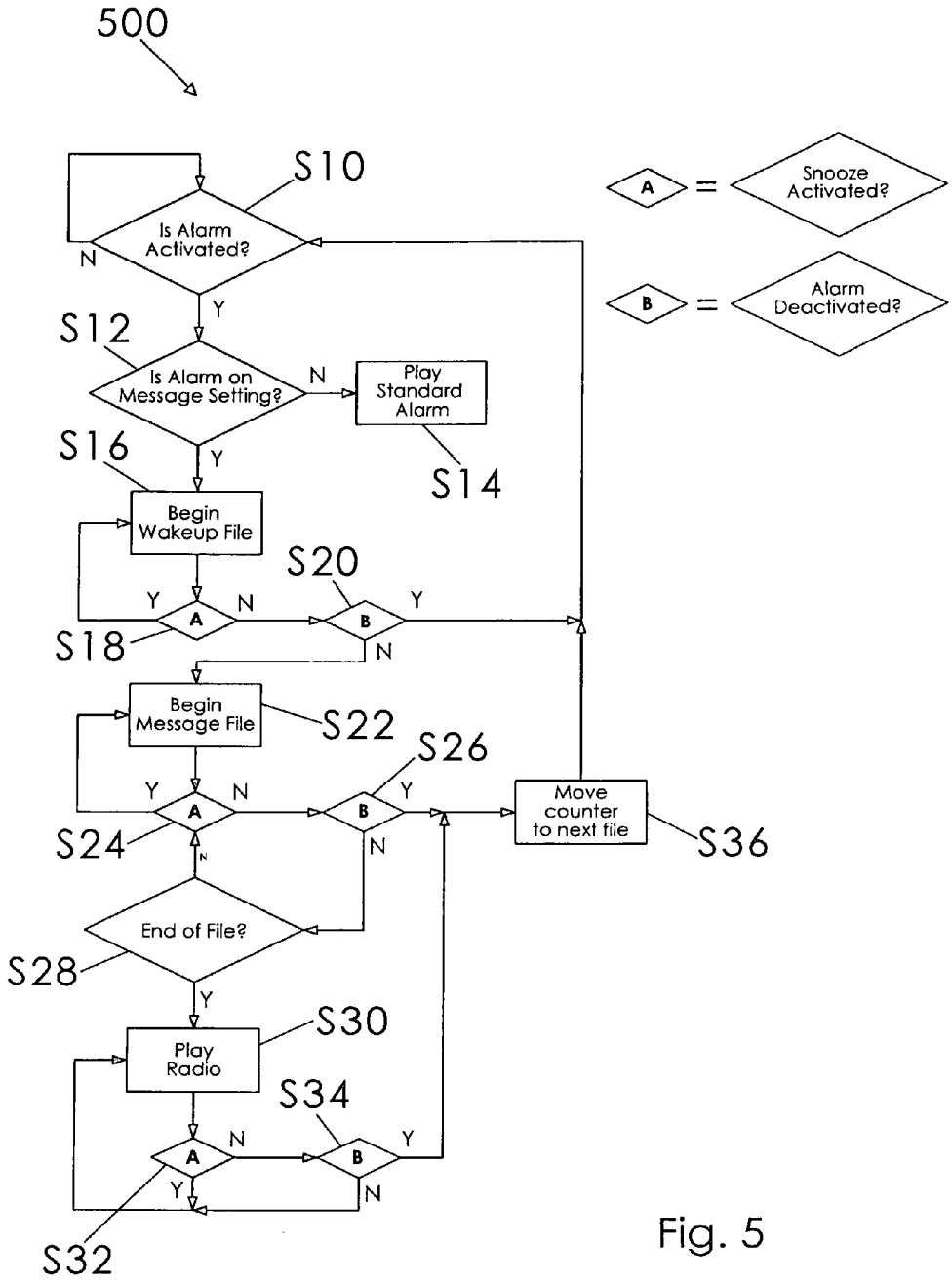
FIG. 5 is a flowchart illustrating the logic performed by the processor according to the present invention.

It should be understood that various embodiments may omit steps set forth above and shown in FIG. 5. For example, steps S16 and S30 may be omitted in certain embodiments. Further, additional steps may be included. For example, programming in the processor 105 may actuate the speaker 110 to re-present an audio message file when the processor 105 receives certain request data from the user input 114.

Accordingly, the alarm clock 100 may be used as set forth above to provide a motivational, educational, or otherwise desirable wake-up experience. For example, audio message files may contain different Biblical excerpts, different facts centering around a common theme or subject, different files made by the user, etc., and the electronic storage device 116 may be replaced to obtain different audio message files in some embodiments.

It is understood that while certain forms of this invention have been illustrated and described, it is not limited thereto except insofar as such limitations are included in the following claims and allowable functional equivalents thereof.

The invention claimed is:

1. An alarm clock, comprising:

a processor;

a plurality of audio message files stored in an electronic storage device in data communication with said processor;

an alarm file in data communication with said processor, said alarm file not being one said plurality of audio message files;

a speaker in data communication with said processor;

a display in data communication with said processor;

a user input in data communication with said processor configured to receive an alarm time supplied by a user;

a clock in data communication with said processor;

a case containing said processor, said speaker, said display, said user input, and said clock;

programming in said processor to:

actuate said display to visually present time data from said clock;

determine if said alarm time has arrived;

determine if an enhanced alarm function has been preselected by a user;

if said enhanced alarm function has been selected, actuate said speaker to audibly present said alarm file and if said enhanced alarm function has not been selected actuate said speaker to audibly present a traditional alarm;

if said speaker has been actuated to audibly present said alarm file, continue to actuate said speaker to audibly present said alarm file until said alarm file has been discontinued by one of a predetermined amount of time and a user input;

determine if said alarm file has been discontinued and, if so, actuate said speaker to present a respective one of said plurality of audio message files;

determine if said respective message file is complete and, if so, discontinue playing any of said plurality of messages until said alarm time is encountered again in the future;

automatically update an indicator associated with said plurality of audio message files to indicate a next audio message file after presentation of said respective audio message file;

prevent said respective audio message file from being audibly presented at a future alarm time at least until each other said audio message file is audibly presented at a respective alarm time;

automatically update said an indicator associated with said plurality of audio message files to indicate a next audio message file after presentation of said respective audio message file.

2. The alarm clock of claim 1, wherein said electronic storage device storing said plurality of audio message files is replaceable with another electronic storage device storing a plurality of different audio message files.

3. The alarm clock of claim 1, further comprising programming in said processor to proceed from actuating said speaker to audibly present said alarm file to actuating said speaker to audibly present said first audio message file only after said processor receives preselected data from said user input.

4. The alarm clock of claim 1, wherein said electronic storage device storing said plurality of audio message files is replaceable with another electronic storage device storing a plurality of different audio message files.

5. The alarm clock of claim 1, further comprising:

programming in said processor to pause a predetermined amount of time between actuating said speaker to audibly present said audio message alarm file and actuating said speaker to resume audibly presenting said alarm file ; and programming in said processor to pause a predetermined amount of time between actuating said speaker to audibly present said respective audio message file and actuating said speaker to resume audibly presenting respective audio message file.

* * * * *